United States Patent [19]

Sandford

[11] 4,377,227

[45] Mar. 22, 1983

[54] STORAGE OF HAND-PROPELLED VEHICLES

[76] Inventor: Don L. Sandford, 28, Station La., Offord Clony, Huntingdon, Cambs., England

[21] Appl. No.: 217,211

[22] Filed: Dec. 17, 1980

[51] Int. Cl.[3] ..... G07F 7/00

[52] U.S. Cl. ..... 194/4 R; 414/227

[58] Field of Search ..... 414/227, 228; 280/33.99 R; 194/4 R; 104/25, 165; 198/321, 725

[56] References Cited

U.S. PATENT DOCUMENTS 3,194,377 7/1965 Fischbach et al. ..... 194/4 R

*Primary Examiner*—Robert G. Sheridan

[57] ABSTRACT

A storage facility for stackable trolleys, as in a supermarket, comprising a unit, such as a display unit against a wall or forming an island, which has a trolley inlet to its interior spaced from a trolley outlet, each adapted to pass one trolley at a time inwards or outwards, and a conveyor for transferring an introduced trolley to the back of a stack and for advancing the stack to release a trolley through the outlet on demand, particularly by action of a coin-freed mechanism. The conveyor is a belt which lifts the front end of a trolley frictionally to drive it on its rear wheels along a guide, while permitting slip to occur beneath a stationary stack of trolleys on demand. In order to encourage trolley return, introduction of a trolley at the input releases a coin in repayment for the coin used to effect trolley release.

12 Claims, 11 Drawing Figures

STORAGE OF HAND-PROPELLED VEHICLES

FIELD OF INVENTION

The present invention relates to the storage of independently movable and stackable objects comprising trolleys and like hand-propelled vehicles and has particular but not exclusive application to the storage of supermarket trolleys and luggage trolleys at railway stations and airports and the like.

BACKGROUND TO THE INVENTION

Such trolleys are free-standing handcarts usually having four wheels and supporting a frame which includes a receptacle for goods (either purchased or luggage in the case of a railway or airport trolley) and the trolley serves as a convenient means for carrying the selected goods or luggage around the supermarket or on railway platforms and around airports.

Although the trolleys are intended primarily for use within the confines of the shop or station or airport etc. it has become increasingly common for them to be used to convey goods to a place, usually a car park, remote from the well defined confines of the shop or other establishment. Not all such trolleys are returned to the originating establishment and the collection of abandoned trolleys is not only an onerous task but is also expensive. Furthermore abandoned trolleys are a frequent object of vandalism and it is an object of the present invention to provide a safe and convenient storage system for such trolleys and other hand-propelled vehicles which can readily be adapted to encourage their return to the establishment from which they have been borrowed.

BRIEF SUMMARY OF THE INVENTION

According to the present invention a storage facility for storing independently movable and stackable objects (hereinafter referred to as trolleys) comprises an inlet through which trolleys can be pushed one at a time, an outlet through which trolleys can leave the storage facility one at a time, conveyor means for conveying trolleys introduced through the inlet in a direction towards the outlet to produce a stack of the introduced trolley with any previously introduced trolleys already within the facility, and means for releasing one at a time trolleys from the other end of the stack through the outlet.

For further clarification, it should be understood that the word "tolley" as employed herein and in the appended claims is intended to include any independently movable and stackable object as exemplified by a supermarket trolley or railway station or airport luggage trolley. However, it is also to be understood that the expression "trolley" is not intended to be limited to any of these particular items and the invention is equally applicable to any situation in which a plurality of independently movable and stackable objects have to be made available to the public or to a group of people, especially when the return of the objects to one or more centralised storage facilities is desirable.

FURTHER FEATURES OF THE INVENTION

According to a preferred feature of the invention the conveyor means is adapted to engage the underside of an introduced trolley to transmit drive thereto.

Preferably the driving engagement between the conveyor means and the trolleys is frictional and allows for slip between the conveyor means and the trolleys so that whilst an introduced trolley will be frictionally engaged by the conveyor means and will be moved in a direction towards the outlet in the facility, the conveyor means will slip relative to the trolley after the latter has become stationary at the end of the stack of trolleys (or at the outlet end of the facility in the event that no trolleys exist therein). Thus, the conveyor means may comprise a conveyor belt and the underside of each trolley may include a transversely extending member which will be engaged by the upper surface of the conveyor belt and will be sufficiently gripped thereby to transmit drive to the trolley as hereinbefore mentioned. The same conveyor belt will preferably, of course, also serve to advance a stack of trolleys towards the outlet when a leading trolley in the stack is released through the outlet, and the advance of said stack may initiate said trolley release at output under the control of said releasing means.

The conveyor belt may be adapted to lift the front of a trolley, thereby to drive it on its rear wheels, guides being provided for guiding said rear wheels (which may normally be turnable) so that the trolley is driven towards the outlet.

Preferably the facility includes means for sensing when the last available trolley has been removed from the stack and preferably means is provided for indicating that the facility is empty of available trolleys when that condition is sensed. Further sensing means is preferably provided for generating a warning signal when the facility is full of trolleys and means is provided for indicating that the facility is full and that no further trolleys should be introduced therein. Conveniently locking means is provided for locking the inlet to the facility in the event that a full condition is sensed.

Conveniently a coin-freed mechanism is provided at the outlet of the facility so that the outlet is opened and a trolley is obtained therethrough only on the insertion of a coin. By coin it is intended to mean a coin of the realm or a token which may for example be purchased against a deposit. Then, in order to encourage the return of the trolleys, the inlet end is provided with a coin outlet through which a single coin is allowed to pass after a trolley has been satisfactorily entered into the facility and has been stacked therein. Again the expression "coin" is intended to cover both coins of the realm and tokens depending on the system operating.

According to a particularly preferred feature of the invention, the facility may comprise a framework having display shelving along at least part of at least one side thereof. In this way the facility may comprise the shelving to be mounted adjacent a wall or may comprise a display shelving island for a supermarket or like establishment. Associated with a railway station or airport terminal, the framework may support similar display shelving for the display and sale of periodicals, newspapers and books or other goods or may provide a support for display shelving for a cafeteria or the like. The important aspect of this feature of the invention is that the space required by the facility need not be lost or wasted and need not be extra to space already used by the establishment whether it be a shop or travel terminal.

Thus, according to another aspect of the present invention, a display stand for a shop or public place comprises an elongate hollow framework having display storage means along at least one elongate face thereof and further comprising at one end an inlet and at the other end an outlet each adapted to pass one at a time a trolley into or out of the hollow interior of the framework, conveyor means for conveying objects introduced through the inlet in a direction towards the outlet to produce a stack of the introduced object with any previously introduced objects already stacked therein and means for releasing one object at a time through the outlet.

It is a preferred feature of the invention that the conveyor means is operated each time a trolley is to be introduced into the stack or is to leave the stack. The same conveyor means serving to move the introduced trolley to the stack may also serve to remove a wanted trolley from the remote end of the stack, although preferably a supplementary conveyor is used to assist fulfilment of the latter purpose. In any event, as previously mentioned, the entire stock of trolleys is moved in a direction towards the outlet whenever the leading trolley is called up from the stack and is passed through the outlet. In this way the stack is continually advanced in a direction towards the outlet as trolleys are called up so that there is always a trolley at the leading end of the stack ready to be released through the outlet (assuming that there are trolleys within the facility).

According to a preferred aspect of this preferred feature of the invention, each operation of the conveyor means is arranged to be of sufficient duration to move a single trolley from the inlet position to the position which the lead trolley in the stack would occupy so that if there are no trolleys in the facility when a trolley is introduced thereinto, the conveyor means will move that trolley all the way to the position at which it will be picked up and released through the outlet upon demand. In this way it is ensured that even if there is only one trolley in the facility, it will be available for call-up through the outlet upon the appropriate call-up procedure being initiated.

DESCRIPTION OF EMBODIMENT

Figure 1:
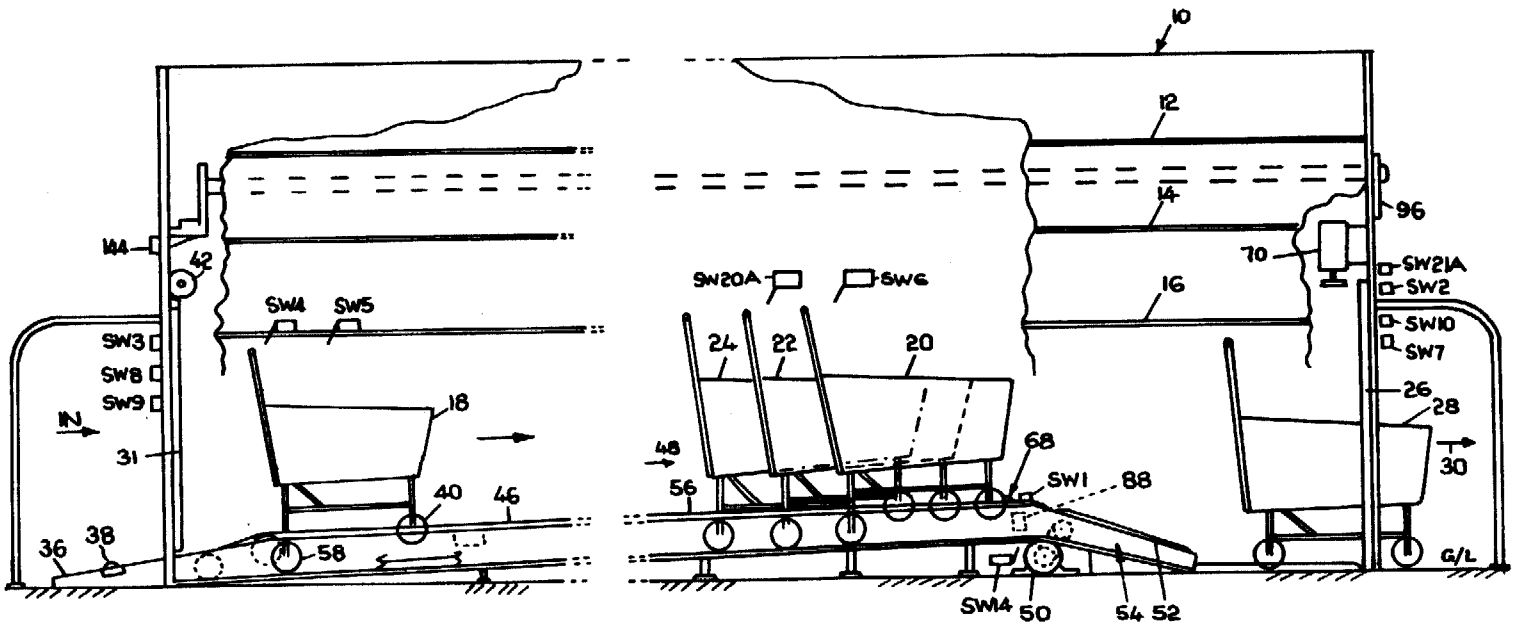
FIG. 1 is a side view of a trolley-stacking facility built into a length of supermarket shelf racking and constructed as an embodiment of the invention.
Figure 2:
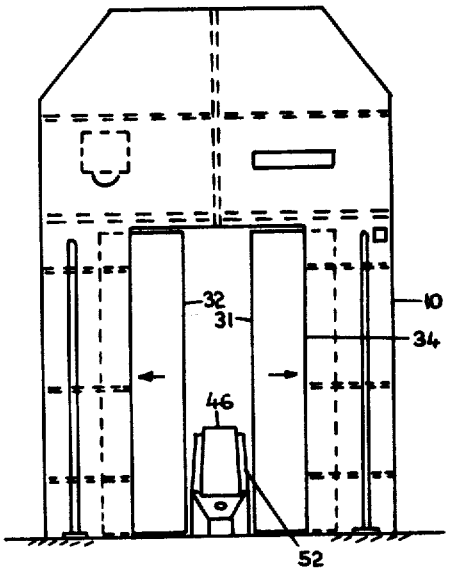
FIG. 2 is an end view of the facility shown in FIG. 1.
Figure 3A:
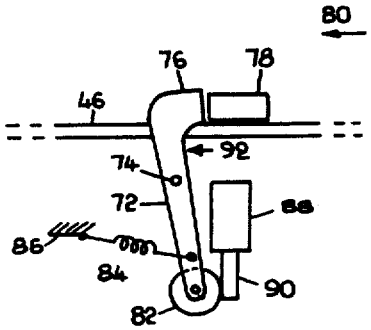
FIG. 3A is a view of a trolley stop device.
Figure 3:
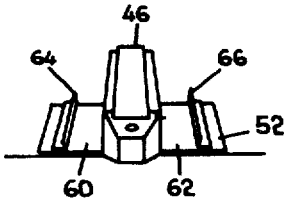
FIG. 3 is an end view of the storage conveyor and guide rails for the trolleys with the remainder of the facility not shown for clarity.

The facility shown in FIGS. 1 to 3 of the drawings is intended for internal use within stores, supermarkets and the like. An alternative arrangement with slight modifications is equally applicable to outdoor use at railway stations and car parks and the like and a still further alternative basically similar to the arrangement shown in FIGS. 1 to 3 may be used at airport terminals and the like.

For use internally, the facility comprises an elongate framework 10 having mounted on one or both sides thereof shelf racking 12, 14, 16. The framework may be against a wall or constitute a free-standing island. The structure is conveniently fabricated from sheet steel or wood and steel and the interior is essentially hollow and serves to house an elongate conveyor (to be described) and the stack of trolleys which are introduced one at a time at one end past a hand rail and can be removed one at a time from the other end upon insertion of a coin or token the value of which can be recovered only by the subsequent insertion of a trolley into the facility.

As applied to external use, the framework 10 and shelving 12, 14, 16 etc. would be replaced by a generally tubular construction (not shown) covered for example with galvanised wire mesh and all the electrical equipment would be flame-proofed and waterproofed or replaced by hydraulic or pneumatic equivalents.

A further point of difference between a facility primarily intended for installation in a shop or the like and one for use at railway stations etc. lies in the fact that in shops it is a disadvantage to require holes and pits and channels to be formed in the floor to permit installation. Consequently the conveyor and the drive for the conveyor is preferably mounted wholly within the framework 10 when the facility is to be fitted within a shop or the like whereas for external use, a channel or pit can be provided into which at least the motor if not some of a conveyor can be located with appropriate drainage from the channel or pit.

Referring now in particular to the facility shown in the drawings, the facility is adapted to receive supermarket trolleys of which one is shown at 18 and others are shown in outline at 20, 22 and 24. It is a feature of such trolleys that they can be stacked in the manner shown by the relative positions of 20, 22 and 24 with the nose of each trolley entering the rear of the trolley in front and passing between the handle and the rear wheels thereof. To this end the rear of each such trolley comprises a hinged flap which lifts up as the nose of a following trolley is introduced into the rear thereof. Such trolleys are well known. Typically, an elongate facility about 11 meters long will accommodate up to 50 trolleys.

The trolley 20 is shown at the head of the stack and is available to be released from the stack through exit doors one of which is shown at 26. The doors are sliding doors and a second door similar to that shown at 26 is provided on the other side of the exit or outlet and a trolley 28 is shown just passing through the outlet in the direction of the arrow 30.

At the opposite end of the facility is provided an inlet with two sliding doors similar to the sliding doors at the outlet end one of which is designated by reference numeral 31 in FIG. 1. The two doors can be seen in FIG. 2 and the second door (not visible in FIG. 1) is denoted by reference numeral 32.

When shut the doors close an opening designated by reference numeral 34 which is wide enough (when unrestricted by the doors) to receive a trolley such as 18.

An input ramp 36 is adapted to receive and raise the front end of a trolley as it is pushed towards the opening 34 and an infra-red sensor 38 is located in the ramp 36 so that as a trolley such as 18 is pushed thereover the front transversely extending axle (or a similar member extending between the two front wheels one of which is shown at 40) passes over the switch and activates the same. Circuits (hereinafter to be described) respond thereto and produce operation of motor drive means 42 for opening the doors 31 and 32 as the trolley is pushed theretowards up the ramp 36.

The ramp 36 causes the transverse rail or axle (previously mentioned) to be lifted onto the lead-in section 44 of a conveyor of which the belt is denoted by reference numeral 46. The belt is moved in the direction of the arrow 48 and is driven by a drive motor 50.

A subsidiary conveyor belt 52 (or an extension of the main conveyor belt 46) serves to pick up the front end of the trolley 20 (when the latter is released) to drive the trolley in a generally forward direction and downward towards the outlet. By having a downward ramp as at 54 leading towards the outlet, so the trolley will gain momentum as it runs down the ramp and sufficient momentum is imparted thereto for it to pass completely through the opening at the far end of the facility (previously described) provided the two doors, of which one is shown at 26, are open. A trolley in that condition is shown at 28, as previously described.

The conveyor belt 46 is mounted centrally of a box section conveyor housing of which the input and output ramps 36 and 54 may be integral or separate members secured thereto. The main box section is denoted by reference numeral 56 and this can be seen not only in FIG. 1 but also in FIG. 2. By providing a box section which rises from the inlet towards the outlet, it is possible to provide complete clearance below the conveyor belt for the drive motor 50 and this eliminates any need to sink the motor in a sub-floor cavity or channel. This facilitates installation.

The front end of the trolley is supported in lifted condition by the belt 46 as hereinbefore mentioned. The rear end of the trolley is supported on its two rear wheels (of which one is shown at 58) and these run on two platforms 60 and 62 (see FIG. 3 and compare with FIG. 1) forming part of the box section conveyor housing and which have thereon guide rails 64 and 66 for retaining the rear wheels laterally.

It is found that the weight of the trolley acting through the transverse axle or member at the lifted front of the trolley on the conveyor belt 46 is sufficient to maintain a frictional drive between the belt and the underside of the trolley and to cause the trolley to be conveyed in a direction towards the outlet (i.e. in the direction of the arrow 48).

However when a trolley such as 18 reaches the rear of the trolley 24 which is the last in the stack, the continued movement of the belt forces the nose of the trolley 18 into the rear of the trolley 24 (in manner known per se) and the trolley 18 continues to move forward until it is fully stacked according to its design into and to the rear of stationary trolley 24. At this stage slippage of the belt occurs particularly since the fitting of the trolley 18 into the rear of the trolley 24 can be arranged to slightly lift the front end of the trolley 18 from its already raised condition, and it is at that point that the trolley 18 will of course cease to move in a forward direction since frictional drive between the belt and the trolley will at that stage cease. The slippage also occurs between the belt and the trolley stack, so long as said stack is unable to advance.

When the conveyor belt 46 is operative to drive forward the trolley 18, it can also be operative, if a trolley output is called for at the front of a stack, to advance any remaining stack of trolleys as far as permitted towards the outlet.

In order to remove a trolley from the stack, it is first necessary to release a trolley stop (not shown in detail) denoted by reference numeral 68. At the same time the belt drive motor 50 is started and the stack of trolleys moves in a generally forward direction (i.e. to the right as shown in FIG. 1) until the front transverse axle or member of the trolley 20 drops down onto the supplementary conveyor belt 52 from where it is drawn in a downward direction towards the outlet. The action of the trolley stop is to release only one trolley and it immediately re-positions so as to prevent the next trolley passing the trolley stop. The released trolley runs down towards the outlet and at the same time the drive motor 70 for the outlet doors of which one is shown at 26, is operated causing the doors to open and allow the trolley to pass therethrough.

It would of course be possible, although less preferable, to employ the supplementary conveyor 52 to pull forward the front trolley 20 in the stack when the trolley stop is released. It would remain desirable, however, simultaneously to operate the belt 46 in order to advance the remaining trolley stack, so that a single drive motor 50 both for belt 46 and conveyor 52 can usually be retained.

Though detail of the trolley stop and indexing device 68 is not given in FIG. 1, FIG. 3A illustrates one form of stop device. This comprises a pair of pivoted arms 72 mounted one on either side of the belt 46 on pivots 74 so that the head of each of the arms (designated by reference numeral 76) extends above the level of the belt 46 for engagement by the leading edge of the transverse member 78 extending across between the front wheels of the leading trolley 20 (see FIG. 1). It should be explained that the direction of movement of the trolleys in FIG. 1 (i.e. in the direction of the arrow 48) is opposite to the direction of movement of the trolleys as shown in FIG. 3A (designated by reference numeral 80).

The lower end of each of the arms is joined by a transversely extending strut (not shown) and at each end of the strut is located a roller or wheel 82.

Each of the arms 72 is biassed by means of a spring 84 attached to a fixed part of the overall assembly 86.

To the rear of the arms and centrally mounted therebetween is a solenoid 88 having a moving armature 90 which normally (when the solenoid is de-energised) hangs down and acts as a stop against which the transversely extending strut (not shown) between the lower ends of the two arms 72 abuts.

A second stop 92 is provided for each arm (or at least one of the arms) towards the upper end and to the rear of each of the arms 72.

In operation the solenoid 88 is energised, thereby lifting the movable armature 90. This frees the arms 72 and will allow them to pivot in an anti-clockwise direction about the pivot 74 (as shown in FIG. 3A) under the weight of the leading trolley (20) and this will allow the leading trolley to move (with the belt 46) onto the downwardly extending ramp section 54 (see FIG. 1) whence the drive to the outlet is taken over by the supplementary conveyor 52. After the first trolley has been released in this way, the springs 84 cause the two arms 72 to revert to their original generally upright position as shown in FIG. 3A and after a specified time interval the solenoid is de-energised causing the armature 90 to drop again so as to provide a stop for the transversely extending strut (not shown). In this way the second trolley in line (22 in FIG. 1) is prevented from passing the stop position as denoted by the heads 76 of the two arms 72 and the second trolley must wait until it is released in a similar manner to that just described.

Figure 4:
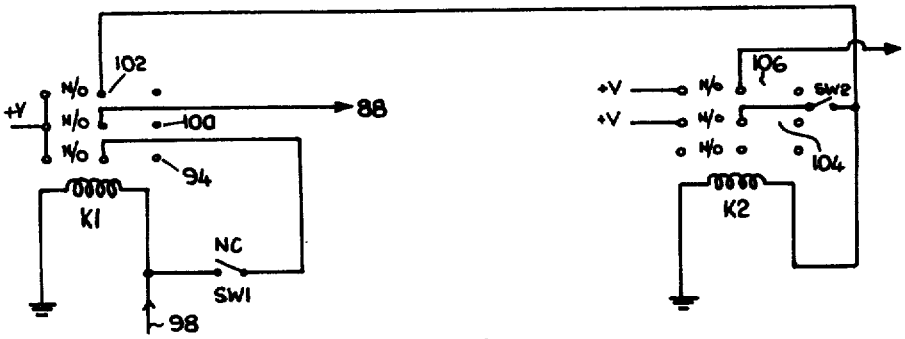
FIGS. 4 to 8, 9A and 9B inclusive are circuit diagrams of the electrical circuits associated with the switches, sensors, drive motors and the like of the facility shown in FIGS. 1 to 3.

The circuit associated with the trolley release is shown in FIG. 4. A relay K1 includes a holding contact set 94 and the holding circuit is completed through a normally closed switch SW1. This latter is located in the path of the trolley and is actuated as the trolley moves down the ramp section 54. With switch 1 opened momentarily relay K1 drops out. The relay is energised initially by a signal from a coin-freed mechanism shown at 96 in FIG. 1. The mechanism is adapted to receive a coin or token and produce an electrical pulse along the line 98 (see FIG. 4) for each such coin or token inserted therein.

The relay K1 includes a second contact set 100 which provides power (when the relay is energised) to the trolley release solenoid 88 (see FIG. 3A and FIG. 1) and a third contact set 102 provides power to a second relay K2 which includes a holding contact set 104, the holding circuit being maintained through a normally closed switch SW2. This latter switch is associated with the doors at the outlet (of which one is shown at 26 in FIG. 1). The signal from the coin-freed mechanism 96 is also used to initiate a door-opening sequence and power is supplied to the motor 70 as required to initially open the doors of which one is shown at 26 and then to close same. The switch SW2 is normally closed but when the doors at the outlet (26 etc.) are finally fully closed switch SW2 opens and breaks the holding circuit for relay K2. Relay K2 therefore supplies power to the belt drive motor 50 via contact set 106 and removes this drive after the doors at the outlet have opened and shut indicating that a trolley has successfully been removed from the stack.

Figure 9A:
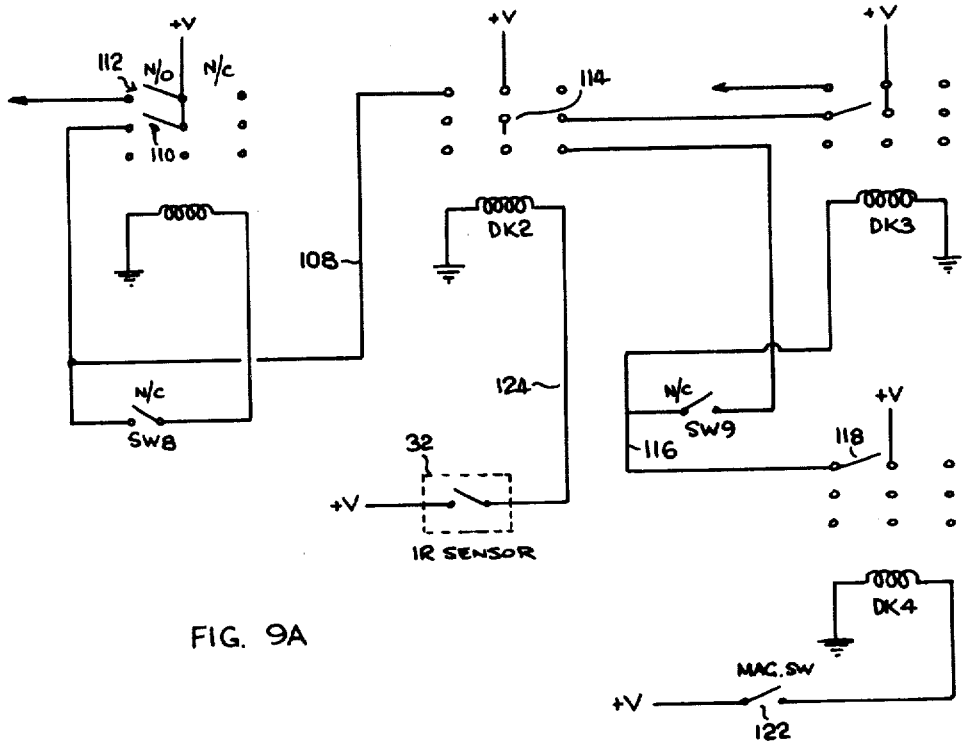

FIG. 9A shows the circuit associated with the input end of the facility. Here the sequence is initiated by the infra-red input sensor 38 which provides a pulse of current to relay DK2. Operation of the relay produces a current pulse along line 108 and since at that stage the doors are not open (i.e. doors 31 and 32) switch 8 is in its normally closed condition and relay DK1 is energised. The relay DK1 includes a holding circuit through contact set 110. The relay is held in until the doors 31 and 32 are fully open when switch 8 is opened momentarily breaking the holding circuit for the relay.

All the time that the relay is held on the contact set 112 is closed and power is supplied to pin 2.

Relay DK2 is not held in by any holding circuit and consequently a third relay DK3 is provided which does include a holding circuit through a normally closed contact set 114 on the relay DK2 and a normally closed switch SW9 which is opened when the doors 31 and 32 are closed. Relay DK3 is thus energised at the beginning of the cycle and de-energises when the doors are finally closed. This provides an output along line 116 to a normally open contact set at 118 on relay DK4.

Relay DK4 is energised when the mag. switch 122 is closed (see FIG. 9A) and provides power for relay DK3.

Figure 9B:
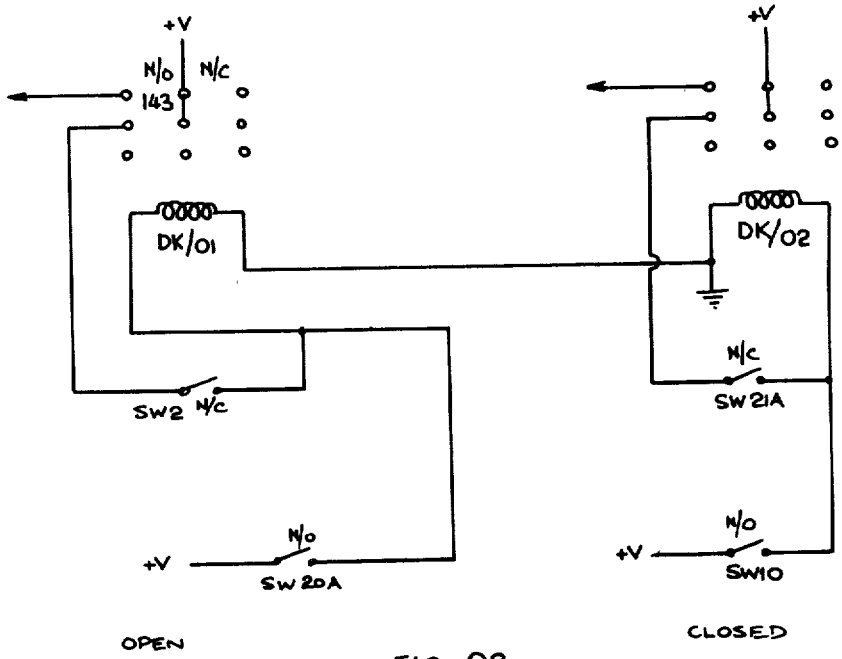

FIG. 9B shows the interlock circuits associated with the output doors (26). Switch SW20A is normally open and is only closed if a trolley is at the position of trolley 22 in the stack. Thus, if no trolley is available, relay DK/01 cannot operate, and the motor for opening the doors 26 etc. is unable to operate.

SW10 (associated with output doors 26 etc.) is normally open, and is closed by the passage of a trolley through the doors 26 etc. to provide power to the motor 70 for closing the doors. Power to the motor 70 is supplied through normally closed switch SW21A which is opened to stop the motor when the doors finally close.

Figure 5:
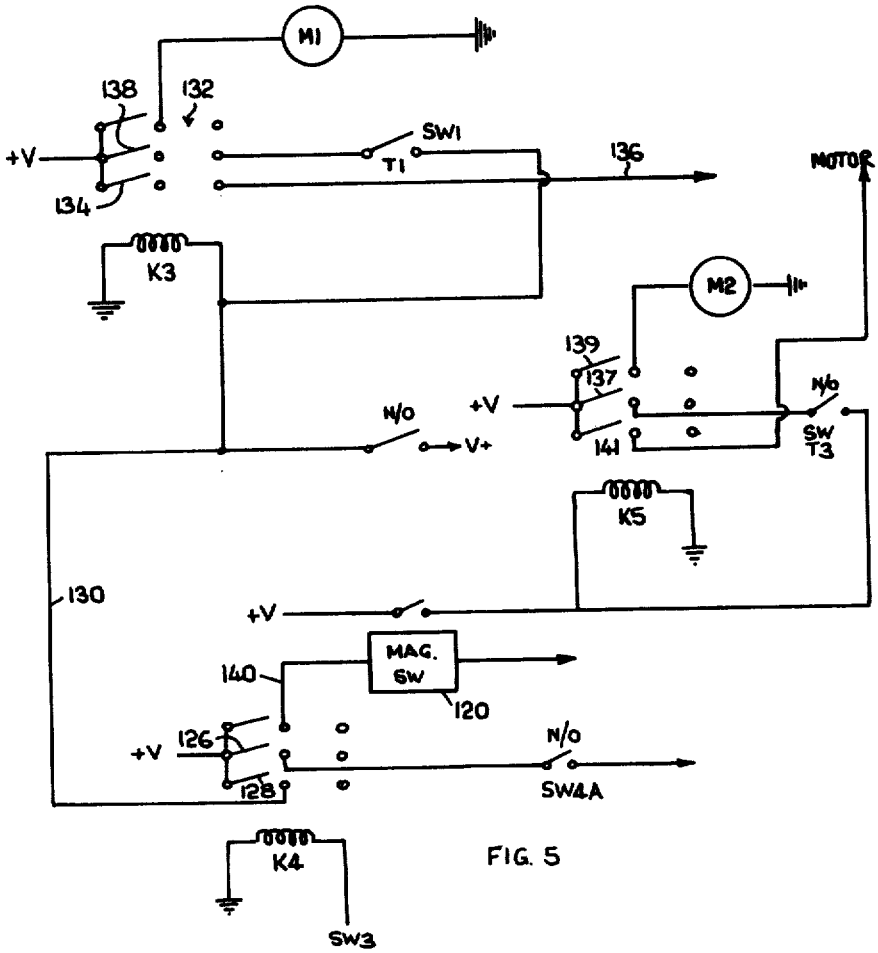

The operation of the doors 31, 32 results in operation of switch 3 which provides a pulse to relay K4 (see FIG. 5). This relay has a holding circuit normally in contact set 126 and normally closed switch SW4. A second normally open contact set 128 provides power along line 130 to a second relay K3 which includes its own holding circuit via normally closed timer switch T1. The contact set operating as the hold-on contact set is designated by reference numeral 132.

Another normally open contact set 134 provides a further output to the main belt drive motor 50 along line 136 whilst the remaining contact set 138 provides an output to the timer motor M1 (see FIG. 5). (M1 is not shown in FIG. 1). M1 is a motor which together with a cam causes a switch T1 to be opened at the end of a specified period of time. This interrupts the hold-on circuit for relay K3 and causes K3 to drop out at the end of the timing period.

At the end of this period the supply to the main belt motor along line 136 is also removed and provided a trolley has passed switch SW4 (so that switch SW4 has been momentarily opened) relay K4 will also have dropped out.

A second N/O switch T2 associated with timer motor M1 supplies current to a relay K5 (see FIg. 5) which includes a holding circuit through contacts 137 and a N/O switch T3 associated with a second timer motor and cam M2. The latter is powered when K5 is operated, via contacts 139. N/O contacts 141 supply power to the main belt motor.

Whilst relay K4 is energised power is available along line 140 to the mag. P/U switch 120 so that a solenoid associated with a pay-out device (not shown in FIG. 1) is energised and a coin or token at the end of the coin-return conveyor (shown at 142 in FIG. 1) can be made available in the coin/token return chute 144.

Figure 6:
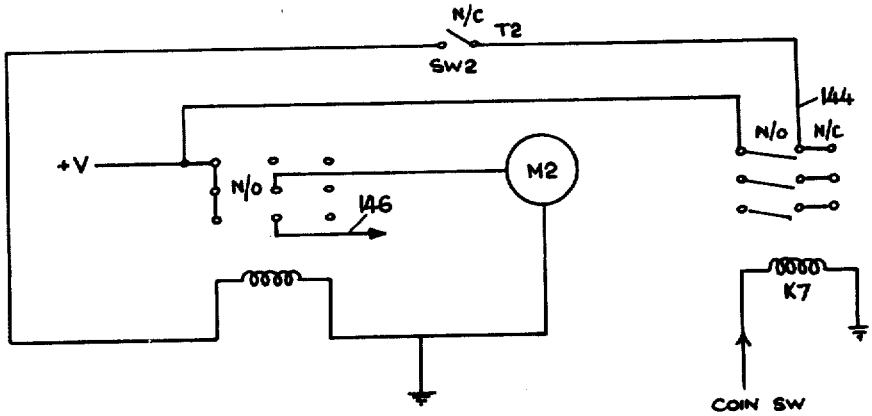

FIG. 6 shows how the drive for a coin-transport conveyor 142 is obtained via relays K7 and K8. Relay K7 is operated from the signal from the coin switch (i.e. line 98 in FIG. 4) and provides power along line 144 through normally closed timer switch T2 to the winding of a second relay K8. Operation of this relay provides power to a timer motor M2 and rotation of the motor and a cam (not shown) associated therewith eventually opens switch T2 thereby breaking the hold circuit which has previously been established for relay K8. Relay K7 only operates momentarily.

The relay K8 provides power to the coin-conveyor motor along line 146.

Figure 7:
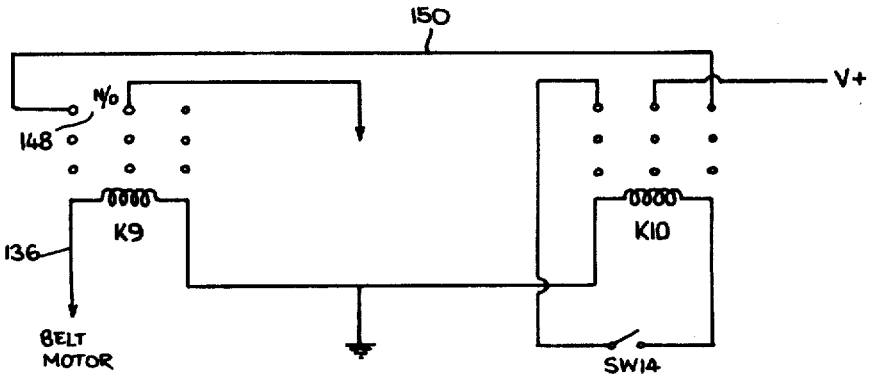

FIG. 7 shows that the line 136 does not go directly to the belt motor 50 but supplies power to a winding of a container K9. Normally open contacts 148 provide the actual power to the belt motor 50 when the contactor is operated.

A belt broken switch (SW14 as shown in FIG. 1) indicates a main conveyor belt break and causes a switch SW14 to open. Relay K10 is normally held energised through the normally closed switch SW14 and in the event that the switch SW14 opens, K10 drops out so removing the mains voltage from the line 150. This means that no further power is available for the belt motor via normally open contact set 148 of the contactor K9. Although this means that the machine will immediately stop in the event of a belt failure, it will also be seen that this prevents undue damage to the belt or other equipment due to the motor continuing to run, either overheating or causing the belt to become wrapped around the various moving parts of the conveyor belt line.

A switch SW6 is provided to indicate if the stack is empty. Switch SW6 is connected in series with the power to the door motor 70 (see FIG. 1)and also when operated causes a sign to become illuminated to the effect that the line is empty.

The operation of SW6 is to inhibit the operation of the doors 26 etc. and can also be arranged to introduce a diversion into the coin path in the coin-freed mechanism 96 so that any coin inserted is returned to the user.

The other condition which must be indicated is whether or not the conveyor is full. In this condition trolleys will be stacked from the lead position illustrated by 20 in FIG. 1 right through to the position shown and occupied by trolley 18.

To this end switches SW4 and SW5 are provided. These switches are located along the length of the conveyor such that when a stacked trolley occupies the position at 18 both switches are closed. The condition causes relay K11 to operate and this provides power to a "stack full" sign along line 152 via contact set 148. In the normally un-energised condition of relay K11, the normally closed contact set 154 provides power to the positive side of switch SW2.

Figure 8:
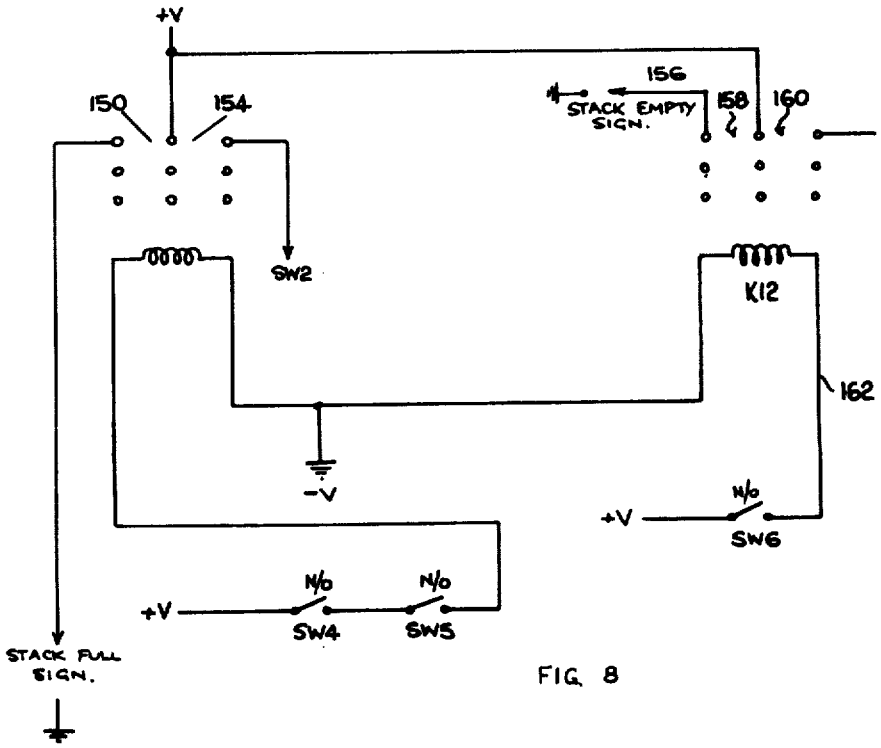

The "stack empty" sign is not shown but the feed therefor is shown in FIG. 8 along line 156 from the normally open contact set 158 of a second relay K12. This latter is energised when switch SW6 is closed and this is only closed in the event that there is no trolley at the position occupied by trolley 20 in FIG. 1. To this end the switch is a normally open switch and the actuator for the switch is sensitive to the presence of a trolley such as the one shown at 20 in FIG. 1.

The normally closed contact set 160 associated with relay K12 provides power along line 162 to the device in the coin-freed mechanism 96 to prevent the insertion of coins and/or deflect inserted coins to a coin-return chute.

It will be appreciated that various modifications of the above-described embodiment are possible within the scope of the invention as defined herein. For example, although generally less convenient, it is possible for the conveyor means to extend along a non-straight path such as a U-path between the inlet and the outlet, for example to facilitate increased capacity. When the conveyor is sunk into a pit or channel, the input ramp may lead downwards; the supplementary ramp at output may lead upwards. Various modifications of the conveyor means and its controls may be made to suit the form of trolley or other stackable object being handled and the circumstances of use thereof. Finally, the coin mechanisms, although not an essential part of the control, clearly encourage the return of trolleys to the facility and are materially advantageous for this purpose.

I claim:

1. A storage facility for storing independently movable and stackable trolleys, comprising:

an inlet through which trolleys can be introduced one at a time, an outlet through which trolleys can leave the storage facility one at a time, a conveyor means for conveying trolleys introduced through the inlet in a direction towards the outlet to stack an introduced trolley with any previously introduced trolleys remaining within the facility, means for releasing trolleys one at a time from the remote end of the stack through the outlet, means for sensing that the facility is empty and for providing an indication of the empty condition, sensing means for generating a warning signal when the facility is full and for indicating the full condition, and gates at the inlet which are locked shut when a full condition is sensed.

2. A storage facility according to claim 1, wherein the conveyor means is adapted frictionally to engage the trolley with a degree of friction sufficient to drive the trolley to the stack but to allow slip against any trolleys in a stationary stack.

3. A storage facility according to claim 1, wherein the conveyor means comprises a conveyor belt and the underside of each trolley includes a transversely extending member which is engaged by the upper surface of the belt in order to drive the trolley.

4. A storage facility according to claim 1, wherein the conveyor means is adapted to engage the front of the trolley and to lift it, thereby to drive the trolley on wheels at the rear end of the latter.

5. A storage facility according to claim 4, wherein guides are provided for guiding the said rear wheels so that the trolley is driven in a direction towards the outlet.

6. A storage facility according to claim 1, wherein the conveyor means extends between an input ramp and a supplementary conveyor operative under the control of said releasing means to drive a trolley through the output from said remote end of the stack.

7. A storage facility according to claim 1 including a coin-freed mechanism controlling said means for releasing.

8. A storage facility according to claim 7, including a coin released mechanism through which a coin is released responsive to introduction of a trolley through the inlet.

9. A storage facility according to claim 8, including means for conveying coins from said coin-freed mechanism to a store of coins ready for successive release by the release mechanism.

10. A storage facility according to claim 1, including a switching circuit controlling the conveyor means, said switching means being operable to start the conveyor for a predetermined period of drive when a trolley is introduced at the inlet, wherein said predetermined period is not less than that required to drive a trolley from the inlet to the position occupied by a trolley at the remote end of the stack, and said conveyor means also acts to convey any residual stack of trolleys towards the outlet subsequent to release of a trolley through said outlet.

11. A storage facility according to claim 1, comprising a display stand having a hollow framework supporting display storage means on its exterior.

12. A storage facility according to claim 11 constituting a free-standing island display unit.

* * * * *